US007425230B2

(12) United States Patent
Nagl

(10) Patent No.: US 7,425,230 B2
(45) Date of Patent: Sep. 16, 2008

(54) METHOD AND DEVICE FOR PRODUCING PIG IRON AND/OR PIG IRON INTERMEDIATE PRODUCTS

(75) Inventor: Michael Nagl, Reichenau (AT)

(73) Assignees: Voest Alpine Industrieanlagenbau GmbH & Co. (AT); Pohang Iron & Steel Co., Ltd. (KR); Research Institute of Industrial Science & Technology Incorporated Foundation (KR)

( * ) Notice: Subject to any disclaimer, the term of this patent is extended or adjusted under 35 U.S.C. 154(b) by 209 days.

(21) Appl. No.: 10/503,117

(22) PCT Filed: Feb. 10, 2003

(86) PCT No.: PCT/EP03/01280

§ 371 (c)(1),
(2), (4) Date: Sep. 24, 2004

(87) PCT Pub. No.: WO03/068994

PCT Pub. Date: Aug. 21, 2003

(65) Prior Publication Data

US 2005/0126341 A1 Jun. 16, 2005

(30) Foreign Application Priority Data

Feb. 14, 2002 (AT) ..... 234/2002

(51) Int. Cl.
*C22B 4/00* (2006.01)
*C21B 13/14* (2006.01)

(52) U.S. Cl. ..... 75/414; 75/528; 75/538; 75/553; 75/569

(58) Field of Classification Search ..... 75/446, 75/414, 528, 538, 553, 569
See application file for complete search history.

(56) References Cited

U.S. PATENT DOCUMENTS

| | | | | |
|---|---|---|---|---|
| 4,072,504 | A | 2/1978 | Perdahl et al. | |
| 4,849,015 | A | 7/1989 | Fassbinder et al. | |
| 4,978,387 | A | 12/1990 | Kepplinger | |
| 5,185,032 | A * | 2/1993 | Whipp | 75/436 |
| 5,961,690 | A | 10/1999 | Kepplinger et al. | |

FOREIGN PATENT DOCUMENTS

| | | |
|---|---|---|
| FR | 2 143 852 | 2/1973 |
| WO | 97/04136 | 2/1997 |
| WO | 98/15663 | 4/1998 |

OTHER PUBLICATIONS

International Search Report dated Jun. 2, 2003.
U.S. 5,944,871—English equivalent for WO 97/04136.

* cited by examiner

*Primary Examiner*—Roy King
*Assistant Examiner*—Tima M McGuthry-Banks
(74) *Attorney, Agent, or Firm*—Ostrolenk, Faber, Gerb & Soffen, LLP

(57) ABSTRACT

Apparatus and process for producing metal products, in which a metal-containing charge material is melted in a melting unit, and a working gas, in particular an at least partially reducing working gas, is additionally produced in the melting unit. The working gas produced is extracted and if appropriate after cleaning, is used as a carrier gas, at least in part for—preferably pneumatic—transport of an at least partially reduced metal-containing material in the form of fine particles.

15 Claims, 2 Drawing Sheets

METHOD AND DEVICE FOR PRODUCING PIG IRON AND/OR PIG IRON INTERMEDIATE PRODUCTS

BACKGROUND OF THE INVENTION

The invention relates to an apparatus and a process for producing metals and/or primary metal products, in particular pig iron and/or primary pig iron products, in which a metal-containing charge material is melted in a melting unit, and a working gas, in particular an at least partially reducing working gas, is additionally produced in the melting unit, and the working gas produced is extracted.

A wide range of processes and installations for producing metals and/or primary metal products are known from the prior art. In any such process, particular emphasis is placed on optimum utilization of all the existing process-related resources, for example, the utilization of waste heat which is generated. The utilization of these resources, which have often been neglected in the past, makes the system which has been installed much more economical for the customer.

It is an object of the invention to further develop a process and an apparatus for producing metals and/or primary metal products, like pig iron or pig iron products, melting a metal containing charge material producing a working gas and the gas pneumatically transports the material. A method and apparatus of this type can be operated more economically and with greater preservation of resources than has previously been the case in the prior art.

This object is achieved, according to the invention, by the process and apparatus treating the charge material in a treatment reactor and then temporarily storing it in a vessel, a fluidized bed lock, and then transmitting the stored material to the melter gasifier.

On account of the fact that the extracted working gas, if appropriate after cleaning, is used, in particular as a carrier gas, at least in part for—preferably pneumatic—transporting of an at least partially reduced metal-containing material, in particular in the form of fine particles, the working gas which is produced in the melting unit is utilized particularly efficiently. This improves the economics of operation of the melting unit and/or of the metallurgical installation as a whole.

It has not previously been known in the prior art to use the gases produced during a melting process directly to convey or transport at least partially reduced material.

In the prior art, by way of example, belt conveyers or pneumatic conveyer lines are used to transport materials in a metallurgical plant. Pneumatic conveying is much preferred for the conveying of fine ores. The installations for the pneumatic conveying of fine ore which are known from the prior art are, however, expensive, complex and susceptible to faults.

A melting unit for generating working gas is known to the person skilled in the art from patent publication WO 97/04136 A1. Hitherto, this working gas has been introduced directly into a treatment reactor, for example a shaft furnace. Separate pneumatic installations of complex configuration were required for conveying materials in fine particle form.

According to one particular embodiment of the process according to the invention, the present invention is particularly suitable for transporting at least partially directly reduced material which is hot (at least at a temperature above ambient temperature). According to various embodiments of the present invention, the temperature of such a material is more than 100° C. or 200° C., preferably more than 300° C., particularly preferably more than 400° C. or 500°.

According to one particular embodiment of the process according to the invention, during transport the working gas flows around the material, and after transport has been completed, the material is separated from the working gas again.

According to one particular embodiment of the process according to the invention, the working gas, in particular after it has been separated from the material, is introduced into a treatment unit, preferably for at least partial reduction and/or preheating of a solid.

According to one particular embodiment of the process according to the invention, a treatment reactor for treatment, in particular for at least partial reduction and/or preheating, of a charged material which is in particular in the form of fine particles and contains metal, is operated, the treated charge material which is discharged from the treatment reactor being carried by the preferably pneumatic transport into a melting unit and/or another unit for further processing of the treated charge material.

According to a preferred embodiment of the process according to the invention, the treatment reactor is a reduction reactor, in particular a fluidized-bed reactor for the reduction of solids in fine particle form, as is known, for example, from patent U.S. Pat. No. 5,961,690 A1.

According to one particular embodiment of the process according to the invention, the charge material, after it has been treated in the treatment reactor, is temporarily stored, preferably in an intermediate vessel, particularly preferably in a fluidized-bed lock.

According to one particular embodiment of the process according to the invention, the charge material, after the temporary storage, is removed and transported by the working gas, preferably from the intermediate vessel.

According to one particular embodiment of the process according to the invention, the charge material which has been treated in the treatment reactor is at least in part introduced, if appropriate via a fluidized-bed lock and/or another intermediate container, into the melting unit as charge material and is melted.

According to one particular embodiment of the apparatus according to the invention, one or more lines for transferring the working gas from the melting unit to the device for transporting the material is provided.

According to a preferred embodiment of the apparatus according to the invention, a treatment reactor for treating, in particular for at least partially reducing and/or preheating, a charge material which is in particular in the form of fine particles and contains metal, is provided, the device for transport being connected to the treatment reactor and being suitable for transporting the treated charge material.

According to a preferred embodiment of the apparatus according to the invention, the device for transporting the treated charge material leads to the melting unit and/or to another device for further processing of the charge material.

According to a preferred embodiment of the apparatus according to the invention, an intermediate vessel, in particular a fluidized-bed lock, from which, by means of the working gas produced in the melting unit, the charge material which has been discharged from the treatment reactor can be removed, is provided downstream of the treatment reactor.

According to a preferred embodiment of the apparatus according to the invention, a gas/solid separation apparatus is provided, in which the working gas can be separated from the material which has, in particular, been removed from an intermediate vessel and is transported by the device for transport.

According to a preferred embodiment of the process according to the invention, the working gas conveys the charge material to a gas/solid separation apparatus, in particular to a solids cyclone, in which the working gas is then separated from the metal-containing charge material.

According to a further preferred embodiment of the process according to the invention, the charge material is introduced, if appropriate via a fluidized-bed lock and/or another intermediate container, for further refining or processing, into a melting unit or other technical device.

According to a preferred embodiment of the apparatus according to the invention, the melting unit is designed to melt the treated, in particular pre-reduced and/or preheated charge material.

According to a preferred embodiment of the apparatus according to the invention, the device for transport is a line for pneumatically transporting the treated charge material, which line leads from the treatment reactor to a melting unit and in particular at least in part has a brick and/or refractory lining.

According to a preferred embodiment of the apparatus according to the invention, a feed line for the working gas produced in the melting unit is provided at the device for transport, in particular for transporting the treated charge material.

According to a preferred embodiment of the apparatus according to the invention, a suitable control device is provided, which can be used to control the gas flow and/or the flow in the device for transport, in particular the line for pneumatic transport. According to one particular embodiment of the invention, this control device is arranged at the melting unit, in which case if appropriate a controllable volume of working gas is discharged, for example, via a burner, and is therefore not available for operating the device for transporting the material.

According to a preferred embodiment, the invention provides a new type of process for producing metals and/or primary metal products, in particular pig iron and/or primary pig iron products, from a charge material which is in the form of fine particles and contains metal, with the conveying installation which is implemented making do without moving parts.

According to one particular embodiment of the invention, the treated charge material is conveyed out of the treatment reactor, in uncooled form, by means of the pneumatic conveying, via the melting unit, where it is separated from the carrier-gas stream and conveyed, for example by means of gravity conveying or by blowing, into the melting unit, in particular into a melter-gasifier.

According to one particular embodiment of the invention, the device for transport (the conveying installation) does not have any moving parts. This eliminates the high maintenance costs which are known from other pneumatic conveying installations.

BRIEF DESCRIPTION OF THE DRAWING

One particular, non-limiting embodiment of the invention is illustrated on the basis of a diagrammatic sketch, in which.

Figure 1:
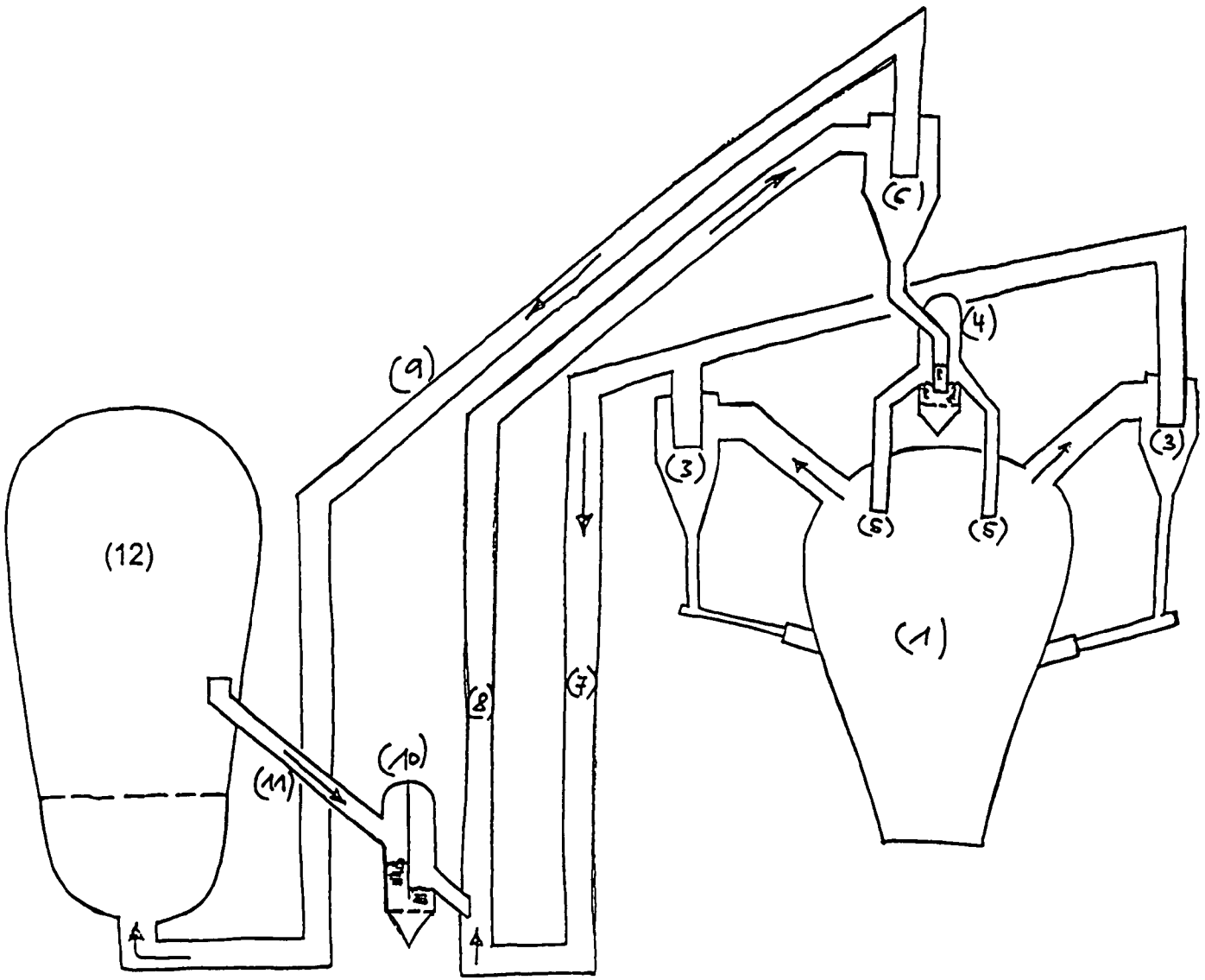
FIG. 1 shows a process and an apparatus for producing metals and/or primary metal products.

A melter-gasifier (1) produces reducing gas at a temperature of between 500° and 900° C., in particular a temperature of from 800° C. to 850° C., which is dedusted in cyclones (2) and discharged in a pipeline (7) with a refractory lining. This pipeline (7) leads to the location where the DRI (direct reduced iron ore)is added to the reducing-gas stream with the aid of a fluidized-bed lock (10). The DRI originates from a treat reacotr, preferable a reduction furnace, in particular a fluidized-bed reduction reactor (12) and passes via pipe 11 to the lock 10

Figure 2:
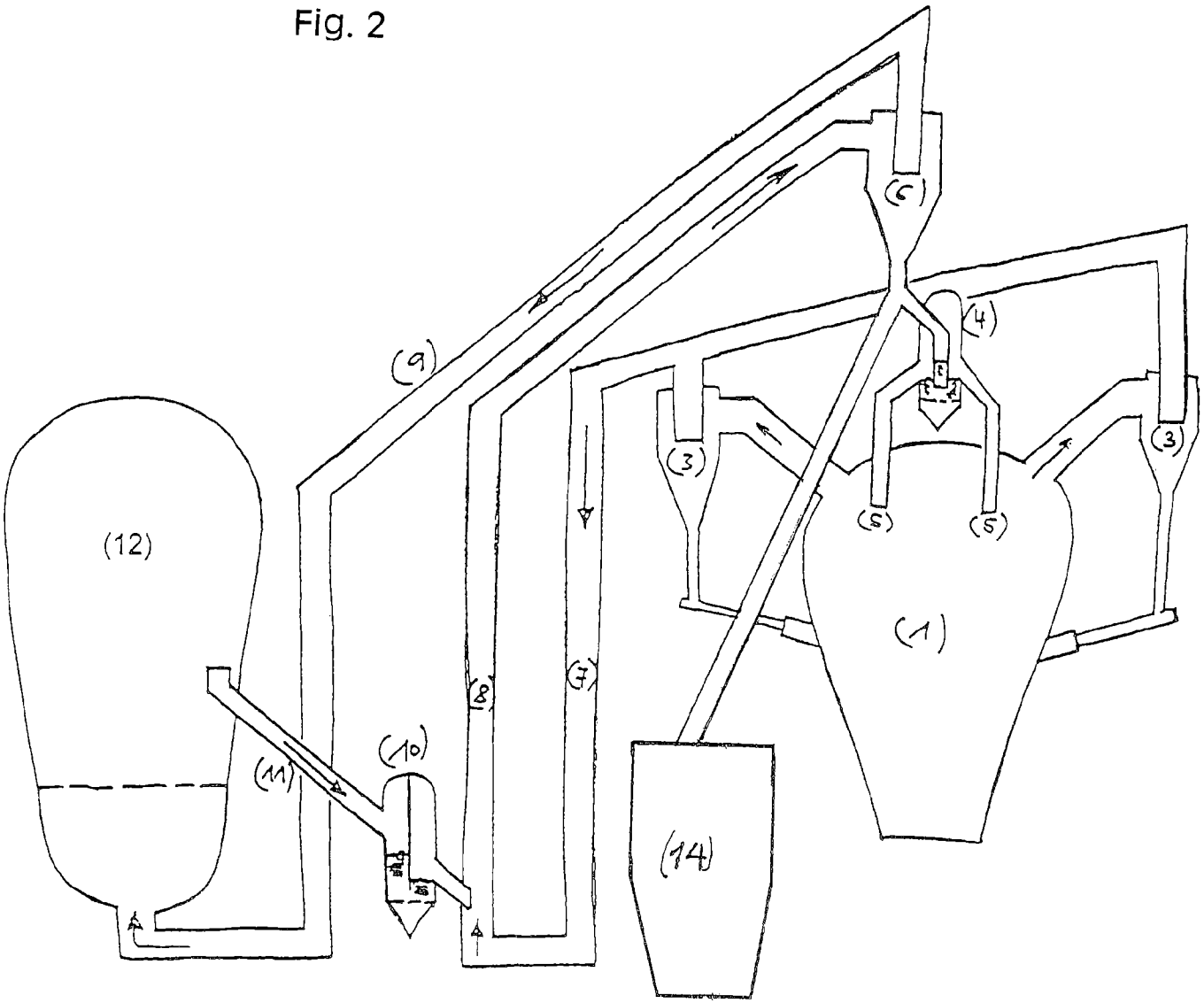
FIG. 2 shows a variation of the process and apparatus of FIG. 1.

A variation of the method and apparatus of FIG. 1 is illustrated in FIG. 2. This is identical to FIG. 1 except that the pneumatically transported charge material, after being delivered to separation cyclone 6, is delivered directly to an alternate treatment unit 14, instead of, or in addition to, melter-gasifier 1.

The reduction gas together with the DRI is then passed over the melter-gasifier in the rising reducing-gas line (8) and passes into a separation cyclone (6), where the DRI is separated from the reducing gas. Once again with the aid of a fluidized-bed lock (4), the DRI passes under the force of gravity and via a plurality of introduction tubes (5) into the melter-gasifier. The reducing gas which has been separated from the DRI is then passed back under the reactor (12) in a pipeline section (9). An extremely high-performance pneumatic conveying installation is realized by the reducing-gas lines (8) and (9) and by the fluidized-bed lock (10).

The invention claimed is:

1. A process for producing metals and primary metal products, comprising:

treating a metal ore in a treatment reactor to produce a charge material for a melter-gasifier comprising an at least partially reduced metal-containing material in the form of fine particles;

melting the metal-containing charge material in a melter-gasifier, and thereby producing an at least partially reducing working gas in the melter-gasifier;

extracting the working gas produced in the melter-gasifier;

temporarily storing the charge material produced in the treatment reactor in an intermediate vessel, thereafter, delivering at least part of the stored charge material over the melter-gasifier by removing the charge material from the intermediate vessel and transporting the removed charge material using at least part of the extracted working gas as a carrier gas, for pneumatically transporting the charge material, after delivery over the melter-gasifier, separating the charge material from the carrier gas by a gas/solid separation apparatus, and thereafter introducing the separated charge material into the melter-gasifier.

2. The process as claimed in claim 1, wherein during transporting the working gas flows around the partially reduced material, and after transport has been completed the partially reduced material is separated from the working gas.

3. The process as claimed in claim 2, wherein after the working gas has been separated from the partially reduced material, the working gas is introduced into the treatment reactor.

4. The process as claimed in claim 1, further comprising cleaning the extracted working gas before it is used for pneumatic transport.

5. The process as claimed in claim 1, wherein the intermediate vessel in which the treated charge material is temporarily stored in a fluidized bed lock.

6. The process as claimed in claim 3, wherein the working gas introduced into the treatment reactor is used for at least partial reduction or preheating of a solid.

7. The process as claimed in claim 1, wherein the treated charge material is introduced into the melting unit via a fluidized bed lock.

8. The process as claimed in claim 1, wherein the removed charge material is transported by introducing it into the carrier gas at an outlet of the intermediate vessel.

9. The process as claimed in claim 1, wherein the gas/solid separation apparatus is a solids cyclone.

10. The process as claimed in claim 1, wherein introduction into the melter-gasifier is done by means of gravity conveying or by blowing.

11. A process for producing metals and primary metal products, comprising:

treating a metal ore in a treatment reactor to produce a charge material for a melter-gasifier comprising an at least partially reduced metal-containing material in the form of fine particles;

melting the metal-containing charge material in a melter-gasifier, and thereby producing an at least partially reducing working gas in the melter-gasifier;

extracting the working gas produced in the melter-gasifier;

temporarily storing the charge material produced in the treatment reactor in an intermediate vessel, thereafter, delivering the stored charge material over the melter-gasifier and/or another unit for further processing by removing the charge material from the intermediate vessel and transporting the removed charge material using at least part of the extracted working gas as a carrier gas, for pneumatically transporting the charge material, after delivery over the melter-gasifier, separating the charge material from the carrier gas by a gas/solid separation apparatus, and thereafter introducing the separated charge material into the melter-gasifier.

12. The process as claimed in claim 1, wherein introduction into the melter-gasifier is done by a fluidized bed lock and/or another intermediate container.

13. The process as claimed in claim 11, wherein the gas/solid separation apparatus is a solids cyclone.

14. The process as claimed in claim 11, wherein introduction into the melter-gasifier is done by means of gravity conveying or by blowing.

15. The process as claimed in claim 11, wherein introduction into the melter-gasifier is done by a fluidized bed lock and/or another intermediate container.

* * * * *